US006543778B2

(12) United States Patent
Baker

(10) Patent No.: US 6,543,778 B2
(45) Date of Patent: Apr. 8, 2003

(54) PAPER ROLL TARGET APPARATUS

(76) Inventor: Jon Ellis Baker, P.O. Box 857, Fort Jones, CA (US) 96032

( * ) Notice: Subject to any disclaimer, the term of this patent is extended or adjusted under 35 U.S.C. 154(b) by 0 days.

(21) Appl. No.: 09/811,616

(22) Filed: Mar. 20, 2001

(65) Prior Publication Data

US 2002/0125645 A1 Sep. 12, 2002

Related U.S. Application Data

(60) Provisional application No. 60/221,370, filed on Jul. 28, 2000.

(51) Int. Cl.[7] ..... F41J 7/00
(52) U.S. Cl. ..... 273/407; 273/403; 273/404
(58) Field of Search ..... 273/407, 408, 273/403, 404

(56) References Cited

U.S. PATENT DOCUMENTS

| | | | | | |
|---|---|---|---|---|---|
| 398,186 | A | * | 2/1889 | Rehfuss | 273/404 |
| 1,928,768 | A | * | 10/1933 | Sell et al. | 273/317.2 |
| 2,048,155 | A | * | 7/1936 | Armantrout | 273/406 |
| 3,087,701 | A | | 4/1963 | Wallace | |
| 3,415,519 | A | | 12/1968 | Hand | |
| 4,029,318 | A | | 6/1977 | Boss | |
| 4,247,116 | A | * | 1/1981 | McQuary | 273/394 |
| 4,548,414 | A | * | 10/1985 | Denis | 273/359 |
| 4,629,188 | A | * | 12/1986 | Mahieu | 273/407 |
| 4,811,956 | A | * | 3/1989 | Foreman | 273/407 |
| 4,884,658 | A | | 12/1989 | Banfield | |
| 5,169,157 | A | | 12/1992 | Salmon | |
| 5,280,920 | A | | 1/1994 | Knapper | |
| 5,829,753 | A | | 11/1998 | Wiser | |
| 6,257,584 | B1 | * | 7/2001 | Nasuti | 273/403 |

OTHER PUBLICATIONS

Ashland Lake Gun Club Basic Range Rules, (Ashland); 1990; Website: www.ashlandlakegunclub.org/ranger-ules.htm.*

* cited by examiner

*Primary Examiner*—Mark S. Graham
(74) *Attorney, Agent, or Firm*—Terry M Gernstein

(57) ABSTRACT

A target assembly includes special paper on which a target is imprinted and which is stored on a feeder roll in a frame and which is moved past a target area in the frame to either a take-up roll or to an exit slot. If the paper passes through the exit slot, it can be moved past a cutting slot and cut off using a knife or the like. The paper is a special rosin sized sheathing, such as forty pound wax paper, which retains the desired orientation during a target shoot, as well as makes clean, precise holes when impacted by shot whereby a precise record of a shot is made. An area on the paper adjacent to each target can be used to record data pertinent to the shoot whereby a firearm can be sighted in or a load adjusted.

17 Claims, 15 Drawing Sheets

PAPER ROLL TARGET APPARATUS

This application claims the benefit of Provisional Application No. 60/221,370, filed Jul. 28, 2000.

TECHNICAL FIELD OF THE INVENTION

The present invention relates to the general art of firearms, and to the particular field of targets for firearms.

BACKGROUND OF THE INVENTION

Most, if not all, firearms should be sighted in in order to obtain the most accurate results. Sighting in generally requires aiming the firearm at a target using the sighting system on the firearm then firing at the target. The difference between the targeted location and the location actually hit is used to correct the aiming system of the firearm.

This same system can be used to control loading of ammunition. The ammunition loading parameters are altered until a desired result is obtained. The actual versus the desired results are measured by firing at a target and recording the parameters of the load.

While the art contains many examples of targets, the inventor is not aware of any targets that are specific to sighting in a firearm or loading ammunition, such as shotgun shells.

Therefore, there is a need for a target that can be used specifically for sighting in a firearm and/or for controlling loading of ammunition.

Sighting in and loading have special requirements. These requirements include notation of various parameters, such as distance, windage, visual conditions, firearm conditions, as well as loading parameters for the ammunition.

Therefore, there is a need for a target that can record the parameters pertinent to a firing test in a manner that is usable by a person testing either a firearm or ammunition to adjust that firearm or ammunition to a desired condition.

The inventor has also observed that if the target is not properly configured, the test results can be affected. For example, if the target is skewed with respect to vertical, holes made in the target by the ammunition may be formed in a manner that may create inaccuracies in the test results. Further, if the holes made in the target are not precise, reading the target may be imprecise and difficult. Still further, if the target is not securely held in place, the accuracy and precision of the test results can be vitiated.

Accordingly, there is a need for a target that can accurately and precisely reflect the results of a test firing.

OBJECTS OF THE INVENTION

It is a main object of the present invention to provide a target that can be used specifically for sighting in a firearm and/or for controlling loading of ammunition.

It is another object of the present invention to provide a target that can record the parameters pertinent to a firing test in a manner that is usable by a person testing either a firearm or ammunition to adjust that firearm or ammunition to a desired condition.

It is another object of the present invention to provide a target that can accurately and precisely reflect the results of a test firing.

SUMMARY OF THE INVENTION

These, and other, objects are achieved by a target assembly for use in sighting in a firearm or for adjusting ammunition loads. The target assembly includes a roll of special paper having a plurality of spaced apart targets thereon as well as a place to record information pertinent to the firing test. The special paper is supported and does not move about in wind conditions and forms precise and accurate holes when penetrated by fired ammunition.

In this manner, the target assembly embodying the present invention provides a shooter with accurate recorded data associated with a particular test. The data can then be used to modify the firearm, its sighting system or the ammunition loading parameters.

Specifically, the target assembly of the present invention includes a frame member that holds the roll of special paper having the targets and data recording locations thereon. The targets are held in precise orientation whereby unwanted and changeable geometry factors do not influence the test results. The roll of targets also permits recording of test data and parameters directly on the roll of paper adjacent to the target. After use, each target can be individually removed from the target assembly whereby a shooter can take the results and recorded data with him for further study. This will assist him in adjusting the firearm or the ammunition loading factors.

BRIEF DESCRIPTION OF THE DRAWING FIGURES

DETAILED DESCRIPTION OF THE PREFERRED EMBODIMENT OF THE INVENTION

Other objects, features and advantages of the invention will become apparent from a consideration of the following detailed description and the accompanying drawings.

Figure 1:
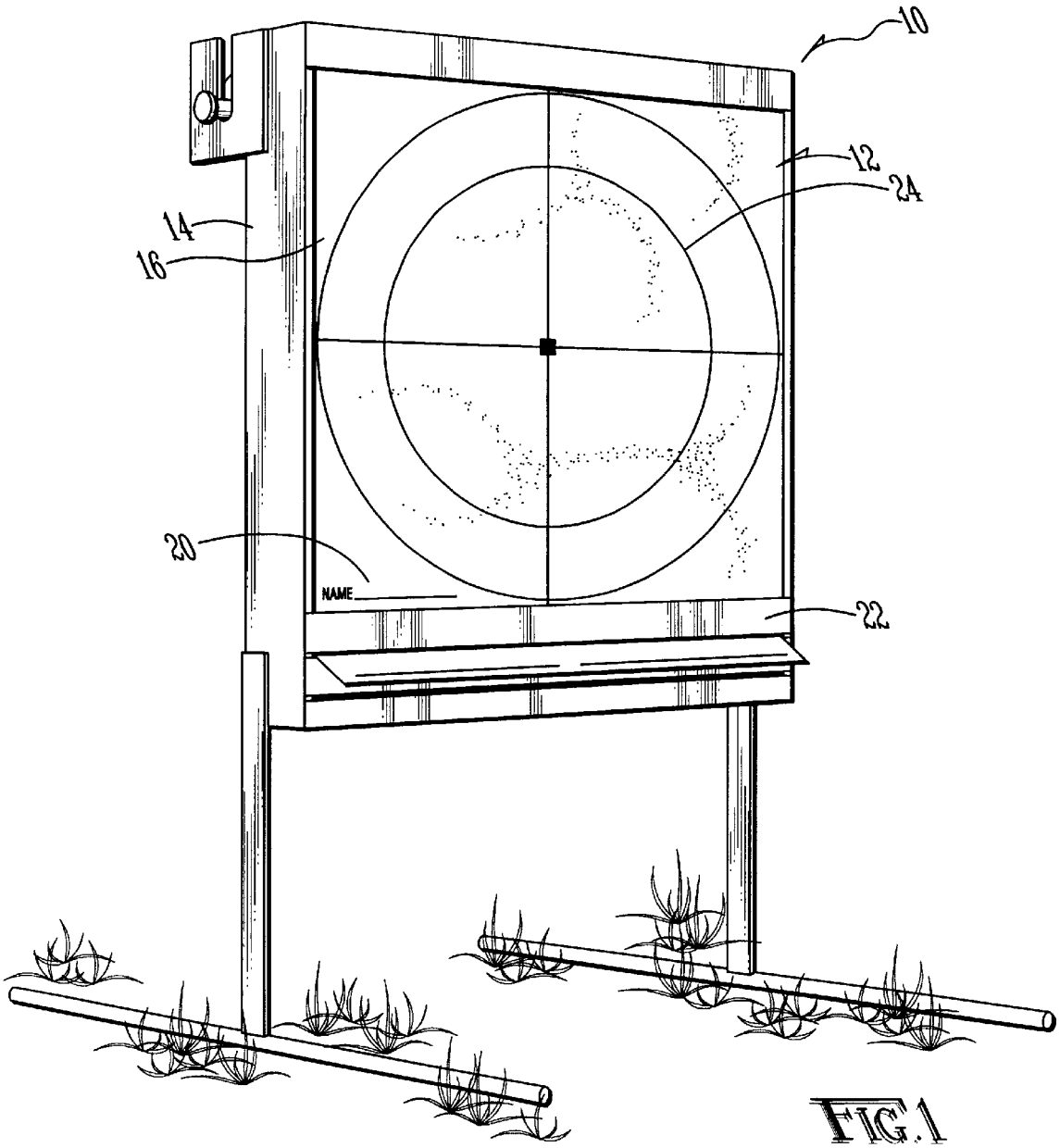
FIG. 1 is a perspective view of one form of the target assembly embodying the present invention.

Referring to FIG. 1, a target assembly 10 embodying the present invention presents a target 12 toward a shooter in a manner that permits the shooter to accurately record a test firing and to record data pertinent to that test firing in a manner that will permit him to accurately analyze the results of the test firing.

Target assembly 10 includes a frame assembly 14 which supports a roll of target-containing paper 16 in an orientation with respect to a shooter that maintains the target 12 in a proper orientation throughout the test. That is, wind does not cause the target to move, and impact between the projectiles and the target does not skew the target whereby holes made in the target are precise and accurately located. Still further, target-containing paper 16, and hence target 12, is formed of a material that punctures very precisely and cleanly, without fraying, when impacted by shot. A hole is also made that nearly perfectly reflects the angle of impact between the shot and the target. This permits the target to accurately and precisely record the test firing. The target paper is stiff enough to achieve these goals, yet flexible enough to be rolled and handled as necessary to achieve the other objects of this invention. Still further, target-containing paper 16 can easily accept ink, pencil or other writing instruments and still be easily read whereby a complete record of a test firing and the parameters and data associated with the test firing can be made directly on the target so there is no danger of confusing one test with another. This is indicated at record area 20 where the recorded data includes the name of the shooter, load information, make/model of the firearm, as well as choke information. Other information can also be recorded in record area 20.

Once a test is completed, each target 12 can be removed from assembly 10 so a shooter can take the test results with him for future reference and analysis. This is achieved by guiding the target through an exit area 22 and then using a knife or other such instrument to cut the used target from a roll of target-containing paper. Pulling the used target through exit area 22 pulls a fresh target down into target area 24. The targets are most efficiently stored on a roll of target-containing paper.

The inventor has found that a particular paper can achieve the just-described goals of remaining stationary during a test, accurately receiving shots and still permitting recording of information as well as being easily stored in a roll and easily cut from that roll to separate each test from the remaining roll of targets.

The inventor has discovered that rosin sized sheathing fulfills the above-described requirements. More specifically, rosin paper, specifically forty pound rosin paper, supplied by Salinas Valley Wax Paper Company, Inc. of 1111 Abbott Street, Salinas, Calif. 93902 (telephone (831) 424-3747). This paper is weather resistant to moisture, wind and sun.

Referring to FIGS. 2–8, target apparatus 10 is seen to include frame 14 that is supported by a stand 30 and which has a top area 32 and a bottom area 34 when the apparatus is in a targeting orientation. A target supporting frame 40 includes top and bottom frame members 42 and 44 respectively and side frame members 46 and 48. Target-containing paper 16 feeds from top area 32 to bottom area 34 in direction 50 and abuts the frame members for support and has sufficient stiffness to remain in a desired orientation during a targeting session.

Figure 2:
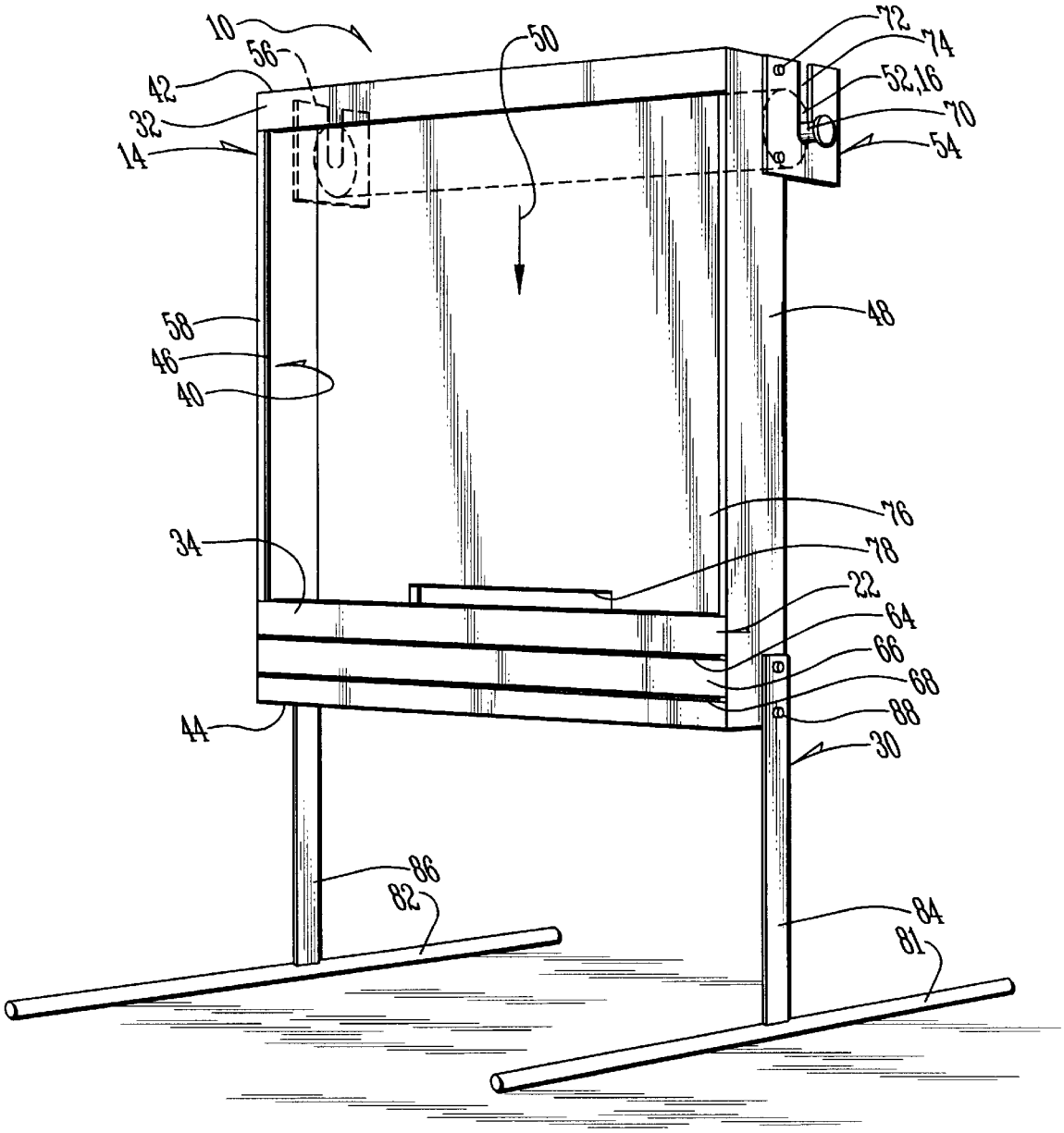
FIG. 2 is a front perspective schematic showing of the FIG. 1 target assembly.
Figure 3:
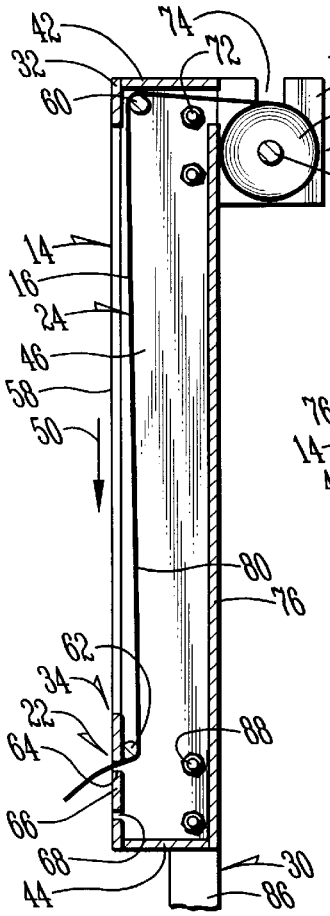
FIG. 3 is a side elevatational view of the target assembly.

Referring to FIGS. 2 and 3, it can be seen that a roll 52 of target-containing paper 16 is supported on brackets 54 and 56 which are mounted on frame 14 adjacent to top area 32 and feeds paper 16 around a guide element, such as bar 57 in direction 50 across front 58 of frame 14 toward bottom area 34. Target-containing paper 16 then is guided around guide elements, such as bars 60 and 62 that are mounted at their opposite ends on frame 14 to extend across the frame from side 46 to side 48. After passing guide element 62, the paper is guided out of an exit slot 64 and down in front of bottom section 66 of frame 14. A cutting slot 68 is defined in section 66 sub-adjacent to exit slot 64. Once the paper is pulled out of the exit slot and down in front of the cutting slot, a knife or other such instrument is used to cut the paper using the cutting slot. This cut will remove one target area from the remaining roll of paper. The target-containing paper is moved as far as the user wishes to be sure he has the entire target and all of the data recorded in area 20 as a record that he can take with him for analysis.

As can be seen in FIGS. 2, 3, 6, 7 and 8, roll 52 of target-containing paper is supported on a bar 70 that is, in turn, supported on brackets 54 and 56 which are fixed to the frame by fasteners 72. A U-shaped slot 74 rotatably receives the ends of bar 70 to support that bar whereby roll 52 can be unwound to feed paper 16 to the frame as described above in direction 50.

Figure 4:
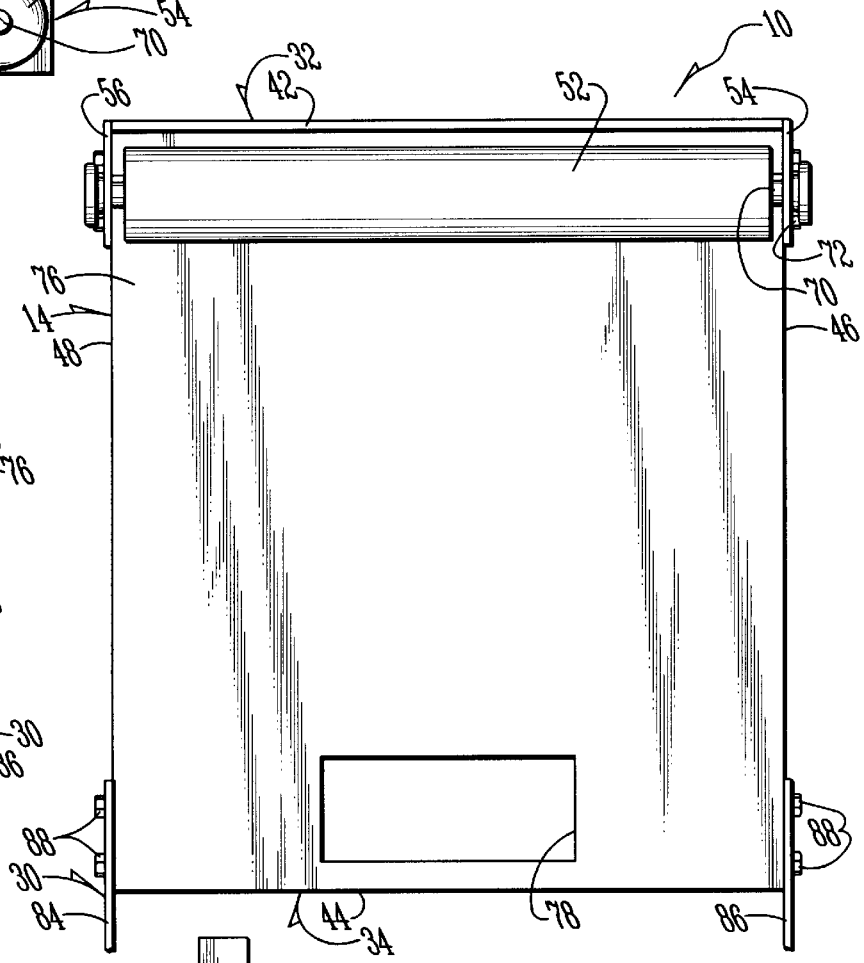
FIG. 4 is an elevational view of the rear panel of the target assembly.

If desired, a back element 76 shown in FIG. 4 can be used on the target assembly. Back element 76 includes an access hole 78 that permits a user to touch the back side 80 of paper 16 if desired.

Figure 5:
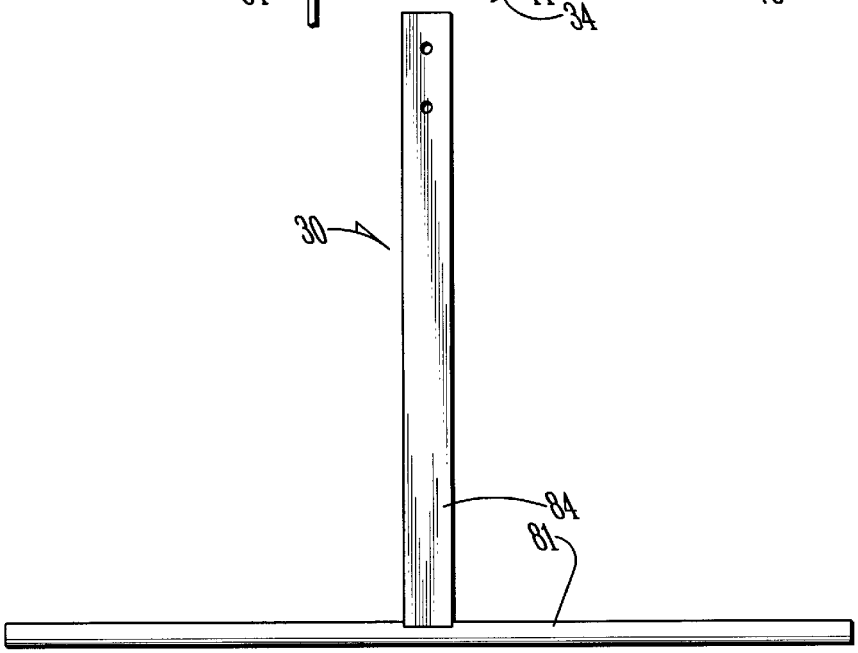
FIG. 5 is a side elevational view of a stand of the target assembly.
Figure 6:
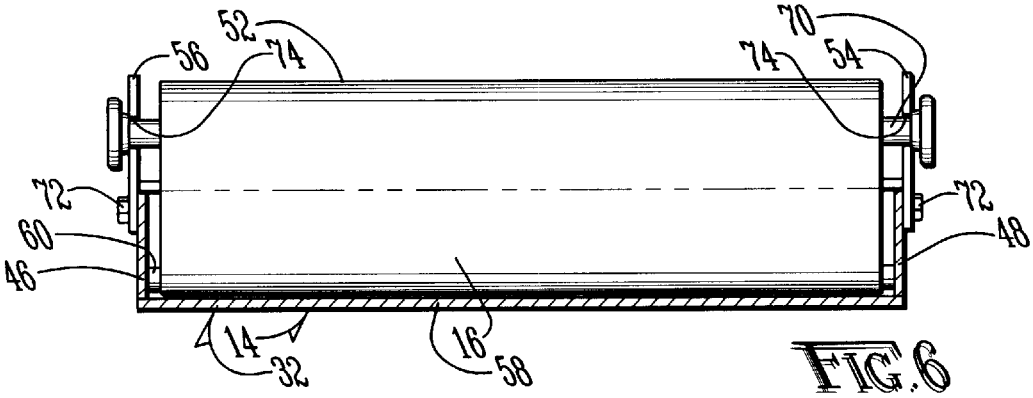
FIG. 6 is a top plan view of the target assembly.
Figure 7:
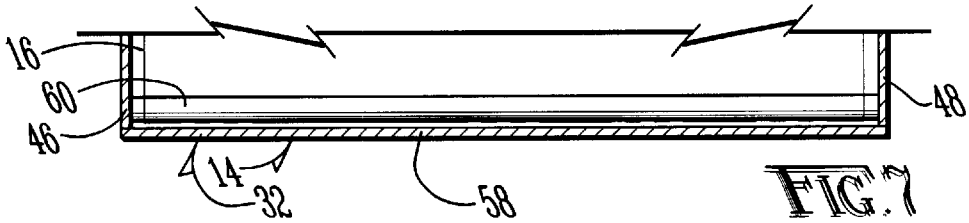
FIG. 7 is plan view of a bar used to support a roll of target-containing paper.
Figure 8:
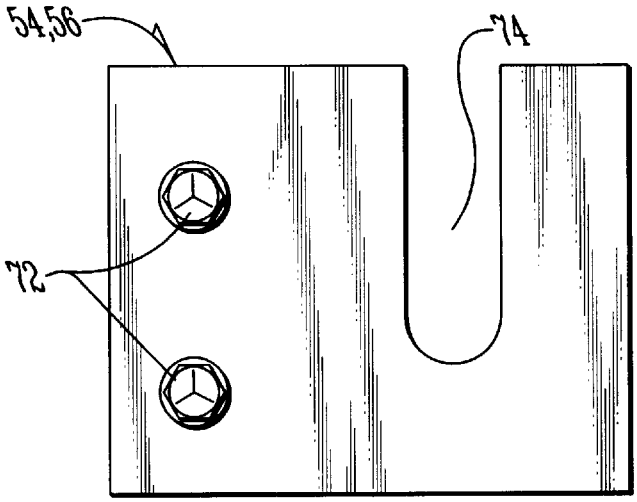
FIG. 8 is an elevational view of a bracket used to support the bar shown in FIG. 7.

Stand 30 is shown in FIGS. 2 and 5 and includes a base elements 80 and 82 that contacts the ground as well as legs 84 and 86 that extend from base elements 82 and 84 to frame 14 to support that frame in position above the ground when target assembly 10 is in position. Legs 84 and 86 are fixed to the frame by fasteners 88.

Figure 9:
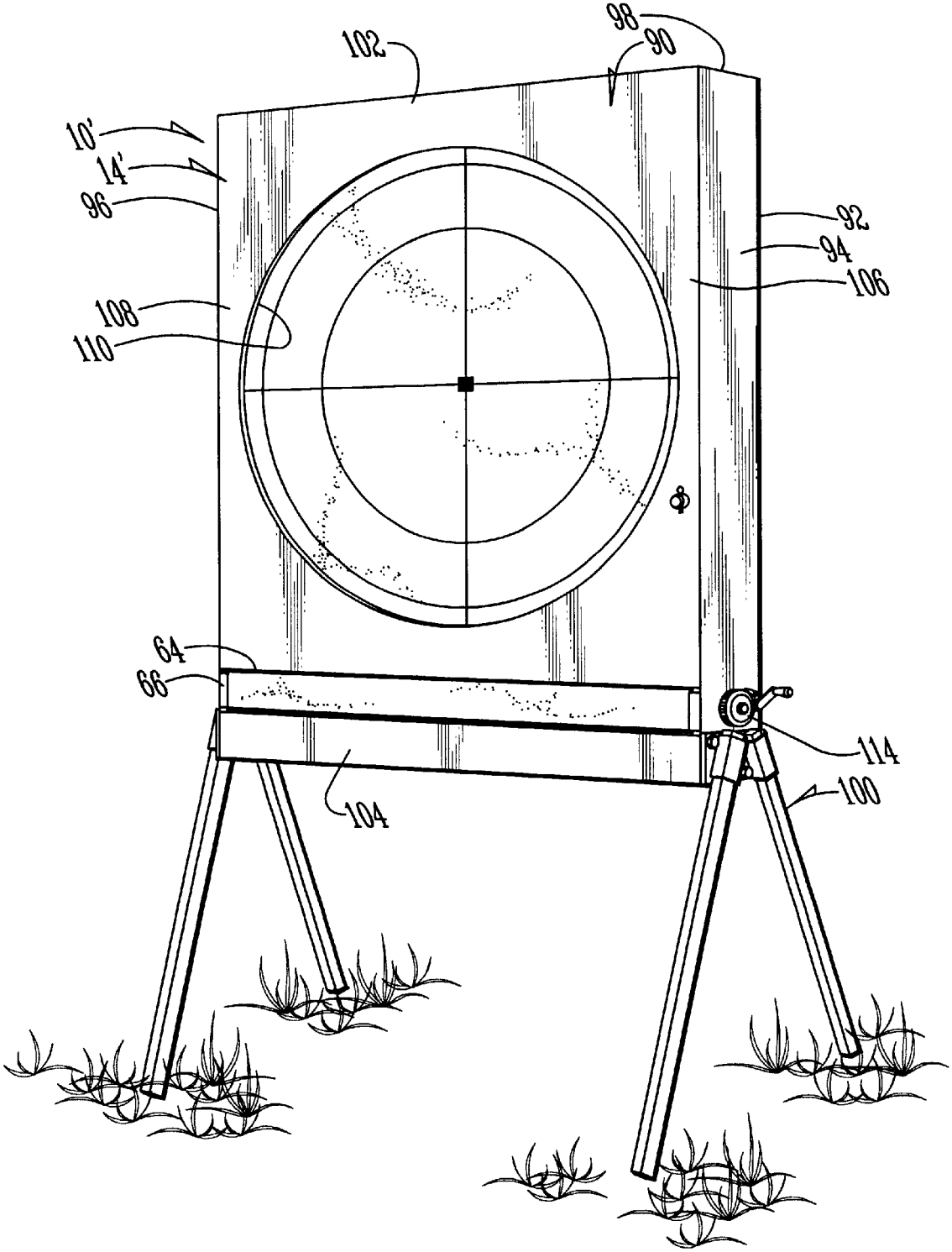
FIG. 9 is a perspective view of another embodiment of the target assembly of the present invention.
Figure 10:
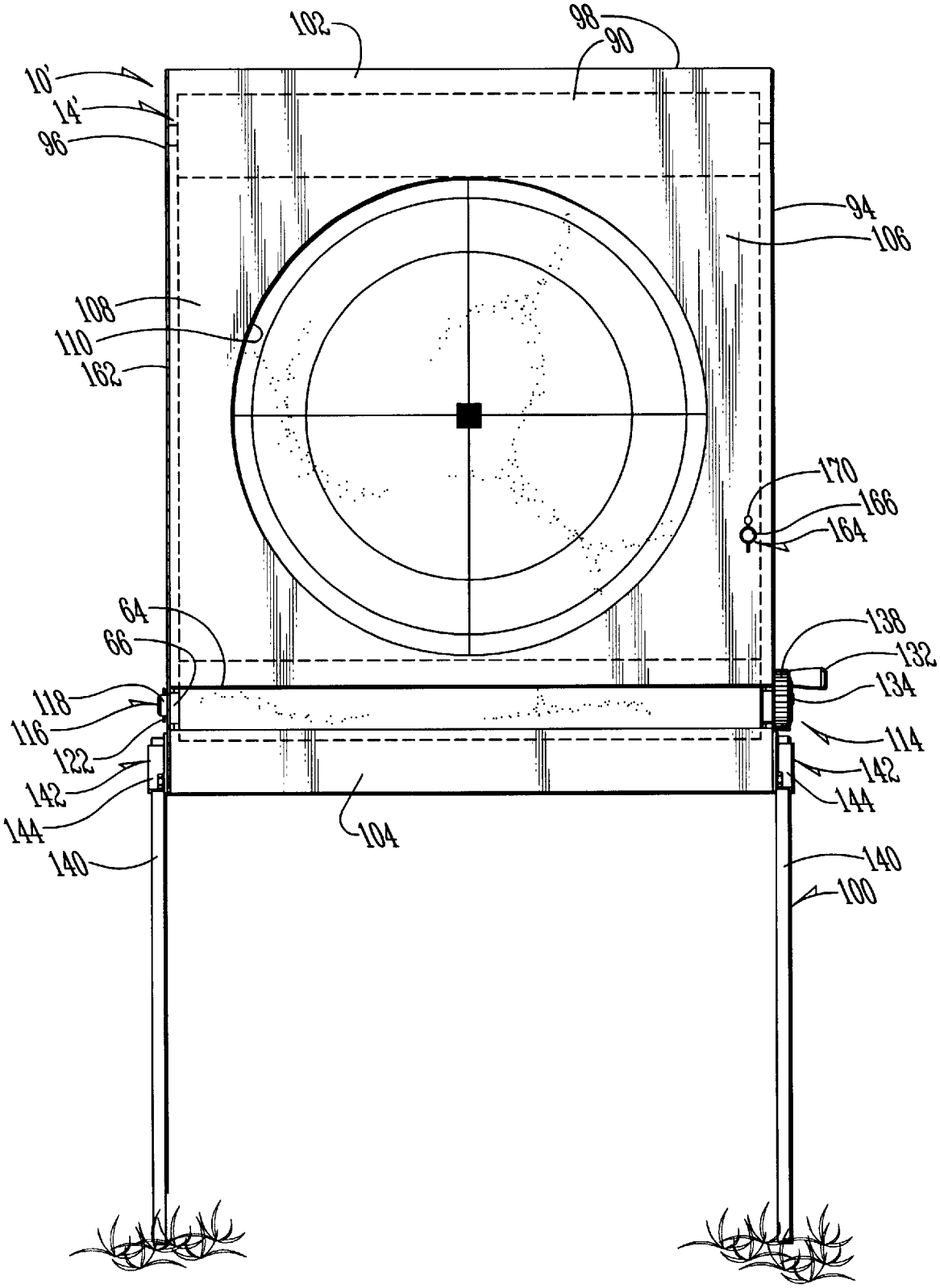
FIG. 10 is a front elevational view of the target assembly shown in FIG. 9.

Another form of the target assembly is shown in FIG. 9 as target assembly 10'. Target assembly 10' operates in the manner described above with regard to assembly 10, but has a frame 14' that encloses the target-containing paper as well as shot that passes through the targets. Thus, as shown in FIGS. 9–12, assembly 10' includes a frame 14' having a front section 90, a rear section 92, side sections 94 and 96 and a top section 98 that are connected together to form an enclosure. A stand 100 supports the frame in position above the ground.

Figure 11:
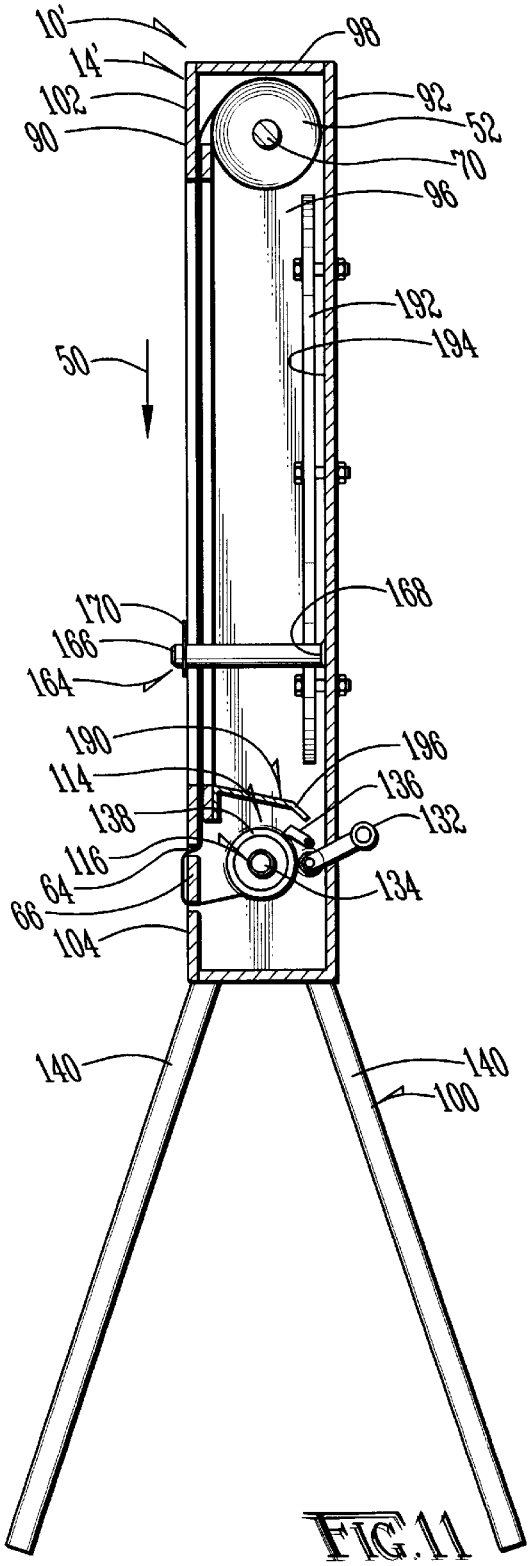
FIG. 11 is a cut-away side elevational view of the FIG. 9 target assembly.
Figure 12:
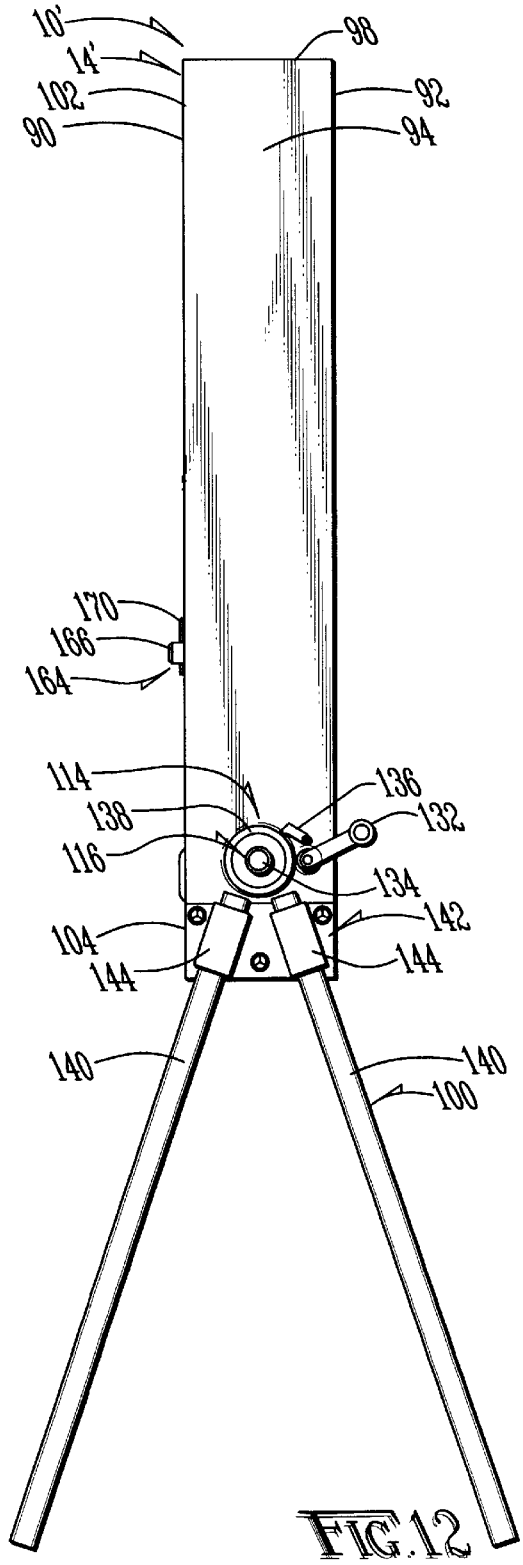
FIG. 12 is a side elevational view of the FIG. 9 target assembly.

Front section 90 is similar to assembly 10 in that it includes a frame top 102, a frame bottom 104, and frame sides 106 and 108 with a target accommodating cut-out area 110 defined therethrough. As shown in FIGS. 9, 11 and 12 target-containing paper is stored on feed roll 52 mounted on a support bar 70 that is rotatably fixed at its ends to sides 94 and 96 of the frame.

Paper is fed from roll 52 in direction 50 across target-accommodating area 110 to exit slot 64 and then in front of cutting slot 66 if the user wishes to remove a target from the roll. However, assembly 10' also includes features that permit the used targets to be stored in the assembly if desired. To this end, assembly 10' includes a paper take-up mechanism 114 mounted in the frame near bottom area 104. As best shown in FIGS. 10, 11, and 21–23, take-up mechanism 114 includes a take-up bar 116 that is rotatably supported at its distal end 118 to side 96. A support bracket 120 is fixed to the inside surface of side 96 to rotatably support bar 116 on side 96, and a cotter pin 122 prevents the bar from moving out of its supported position on the frame. Bracket 120 includes a bar-accommodating hole 126 and is fixed to the frame by fasteners 128. Bar 116 includes a slot 130 into which the free end of,the paper is received to be wound around bar 116 in a take-up operation as will be understood by those skilled in the art based on the teaching of the present disclosure.

A hand crank 132 is fixed to the proximal end 134 of bar 116 to operate that bar in a take-up mode. A ratchet 136 is mounted on the frame and cooperates with a gear mechanism 138 on the bar to control movement of the paper.

Support 100 is shown in FIGS. 10, 11, 24, 25 and 26 as including legs 140 fixed at their upper ends to the frame by a bracket assembly 142 and which rest on the ground to support target assembly 10' in the desired position and orientation. Bracket assembly 142 includes sleeves 144 which receive the top ends of legs 140. The top ends of the legs include fastener-receiving holes, such as hole 148 for fixing the legs to the frame 14.

Figure 13:
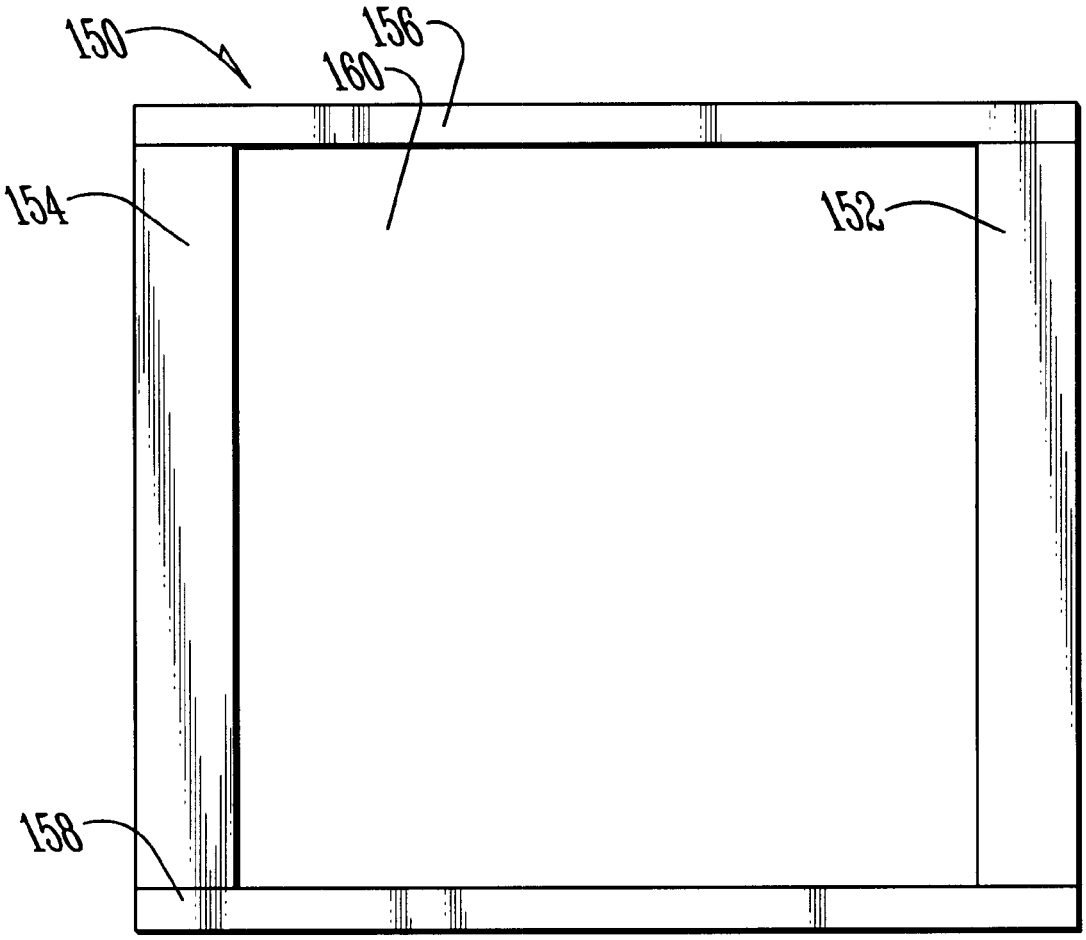
FIG. 13 is an elevational view of a frame support for the roll of target-containing paper.

Further support for the target-containing paper is provided by a support frame 150 shown in FIG. 13. Frame 150 is fixed to the inside of frame 14 and includes sides 152 and 154 that are fixed to the inside surfaces of sides 106 and 108 respectively, top 156 that is fixed to the inside surface of top 102 and bottom 158 that is fixed to the inside surface of bottom 104. A target-accommodating area 160 is defined by frame 150 and surrounds area 110 of frame 14.

Figure 20:
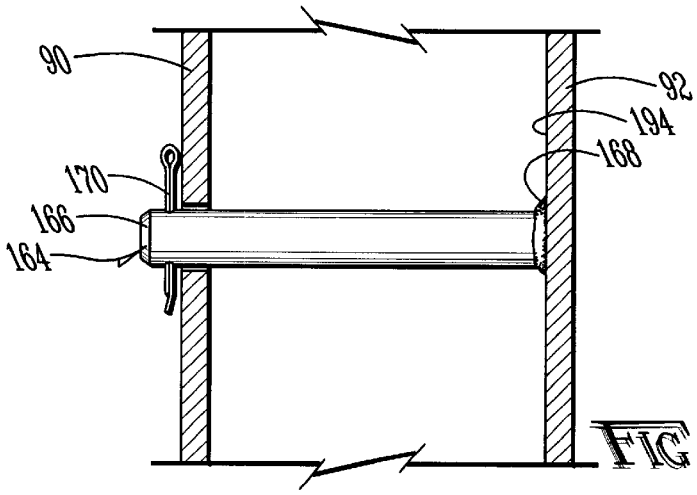
FIG. 20 is shows a door lock used in the target assembly.
Figure 21:
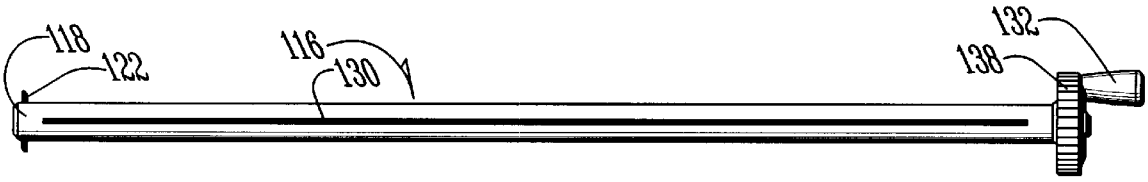
FIG. 21 is a plan view of a take-up element for used target-containing paper in the target assembly.
Figure 22:
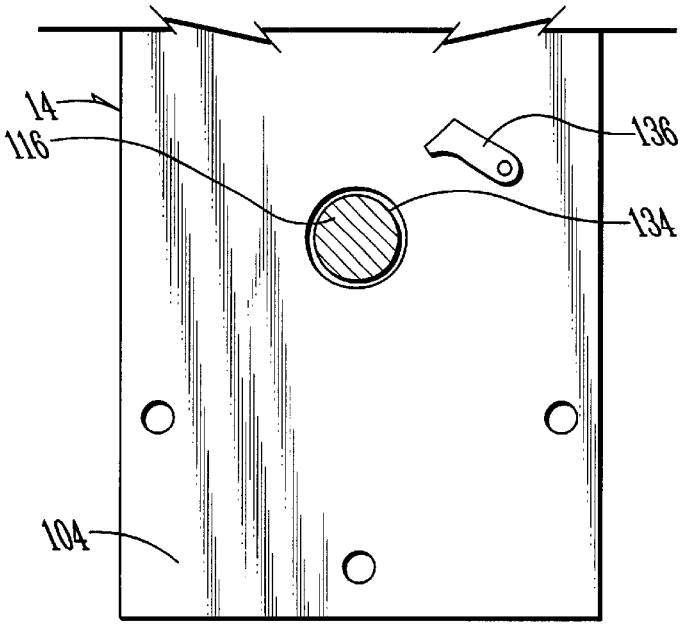
FIG. 22 shows a ratchet element used to control the take-up element.
Figure 23:
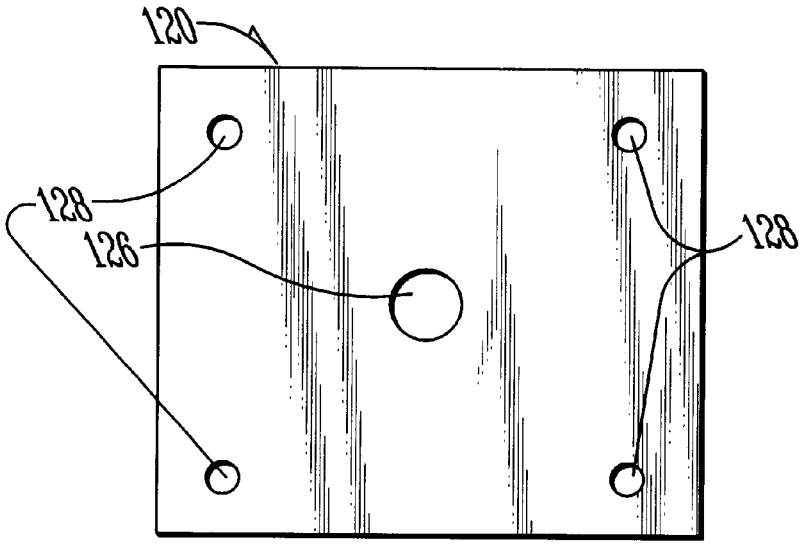
FIG. 23 is a bearing plate used to support the take-up element.
Figure 24:
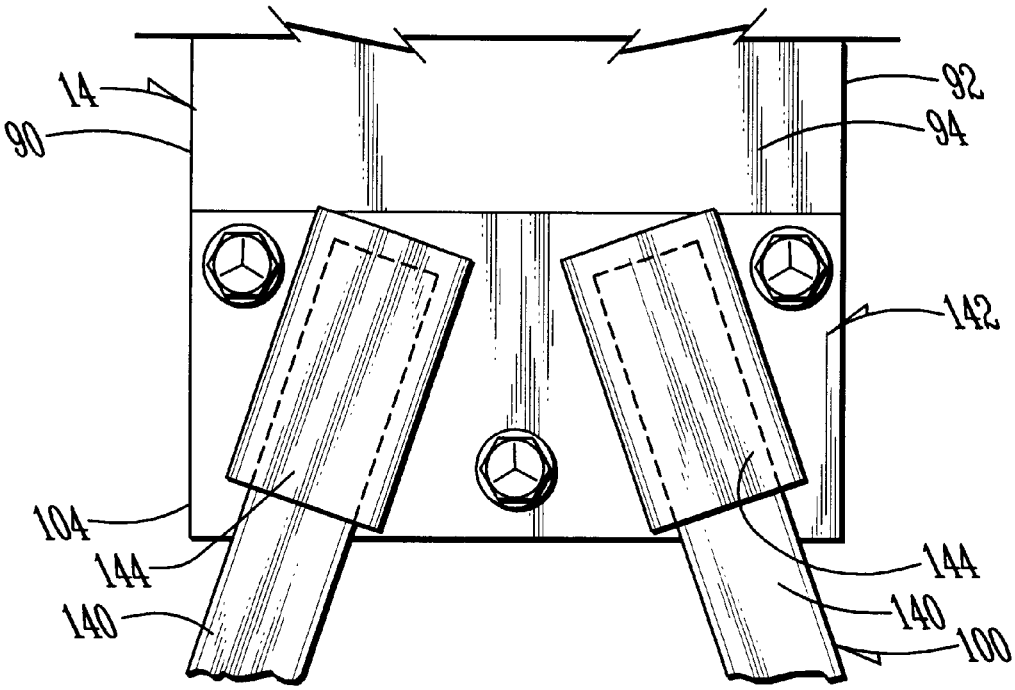
FIG. 24 is a side elevational view showing one attachment of legs to the target assembly.
Figure 25:
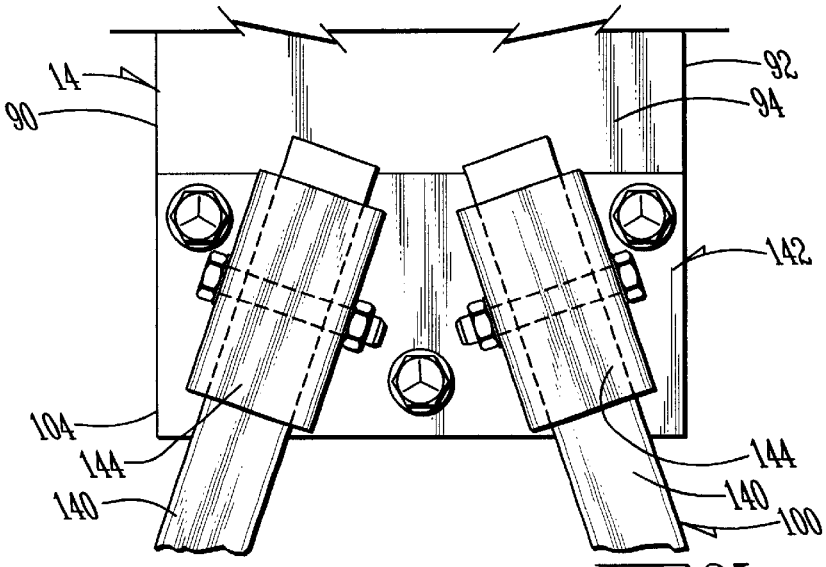
FIG. 25 shows another form of leg attachment for the target assembly.
Figure 26:
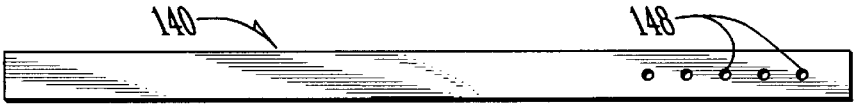
FIG. 26 is a plan view of one leg.
Figure 27:
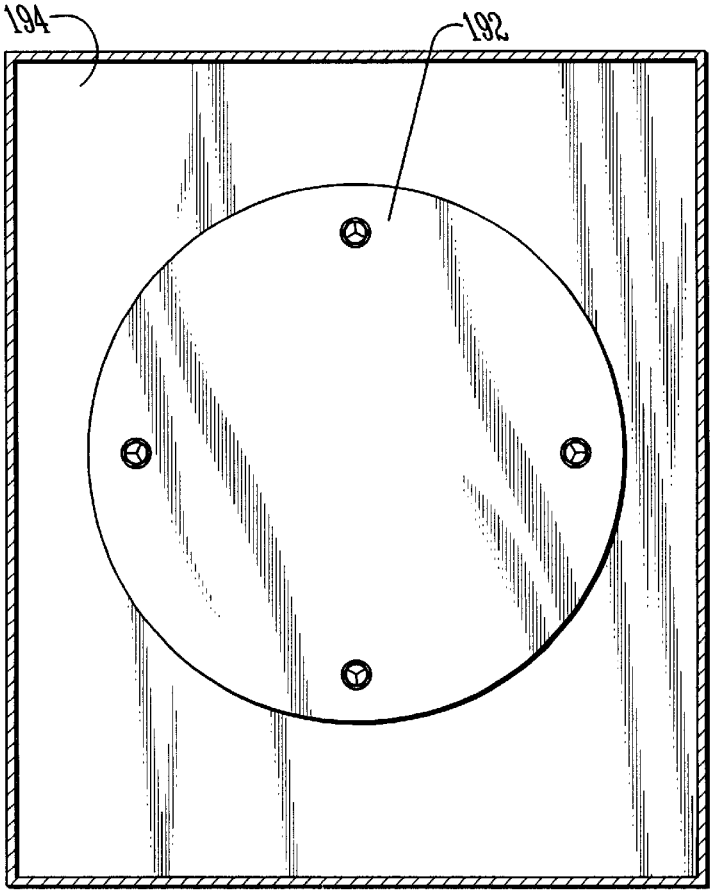
FIG. 27 is an elevational view of a shot splatter plate used in the target assembly.

It is noted that target assembly 10' has front 90 connected to side 96 by a hinge, such as piano hinge 162 whereby the frame can be opened for access to the inside of the frame. Assembly 10' further includes a lock mechanism 164 shown in FIGS. 10 and 20 for maintaining the frame closed. Lock mechanism 164 includes a bar 166 fixed to frame rear 92 as by a weld 168 and has a cotter pin 170 that abuts the front of front 90 to keep the frame closed. The cotter pin is releasably held on bar 166 and can be removed when it is desired to open the frame. Bar 166 extends through a bore defined in front 90 of the frame.

Figure 16:
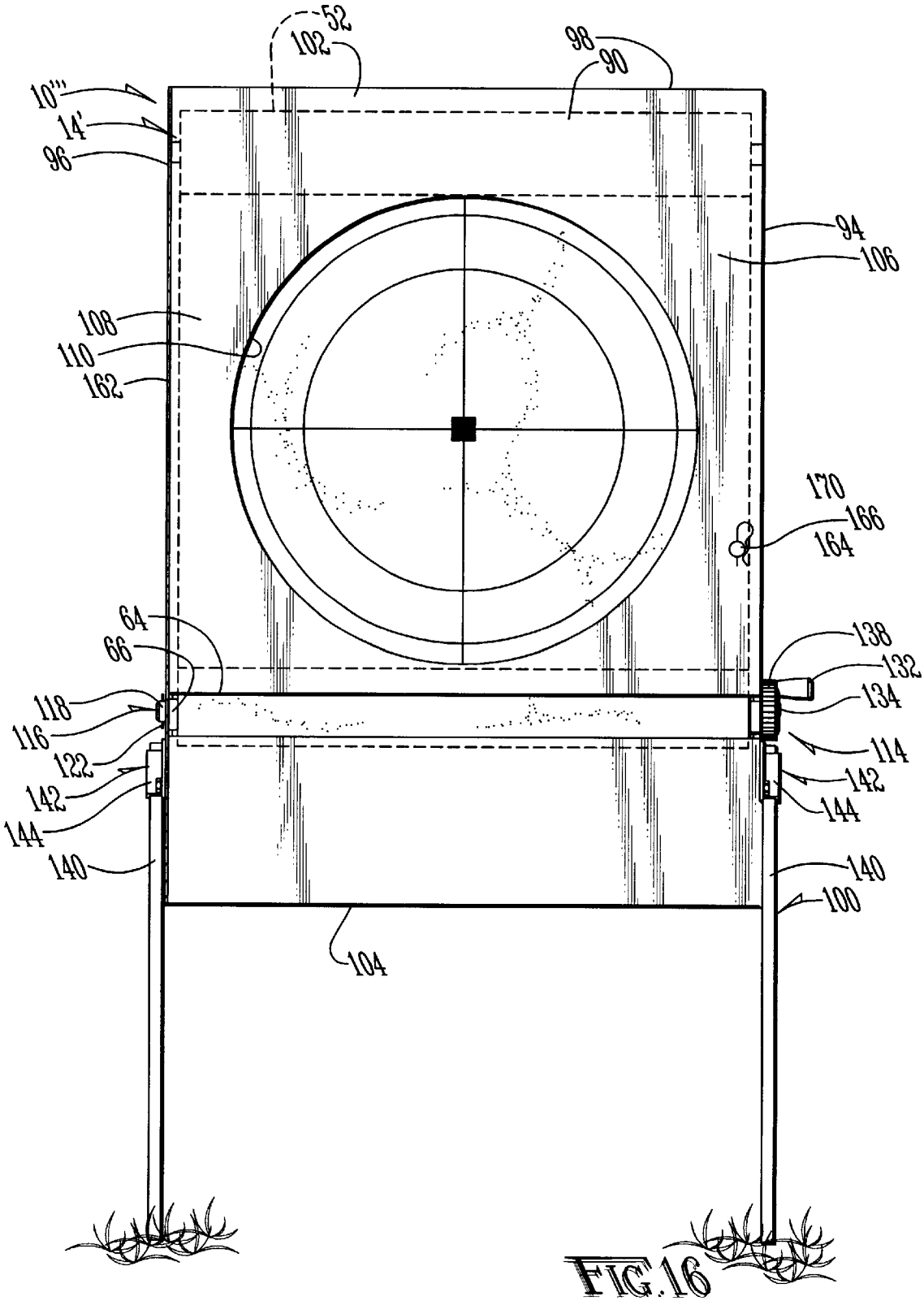
FIG. 16 is a front elevational view of the FIG. 9 target assembly.

It is noted that an alternative form of the assembly can include a storage means for storing used targets until the shooter wishes to take them. Such alternative form is shown in FIG. 16 as assembly 10".

Figure 15:
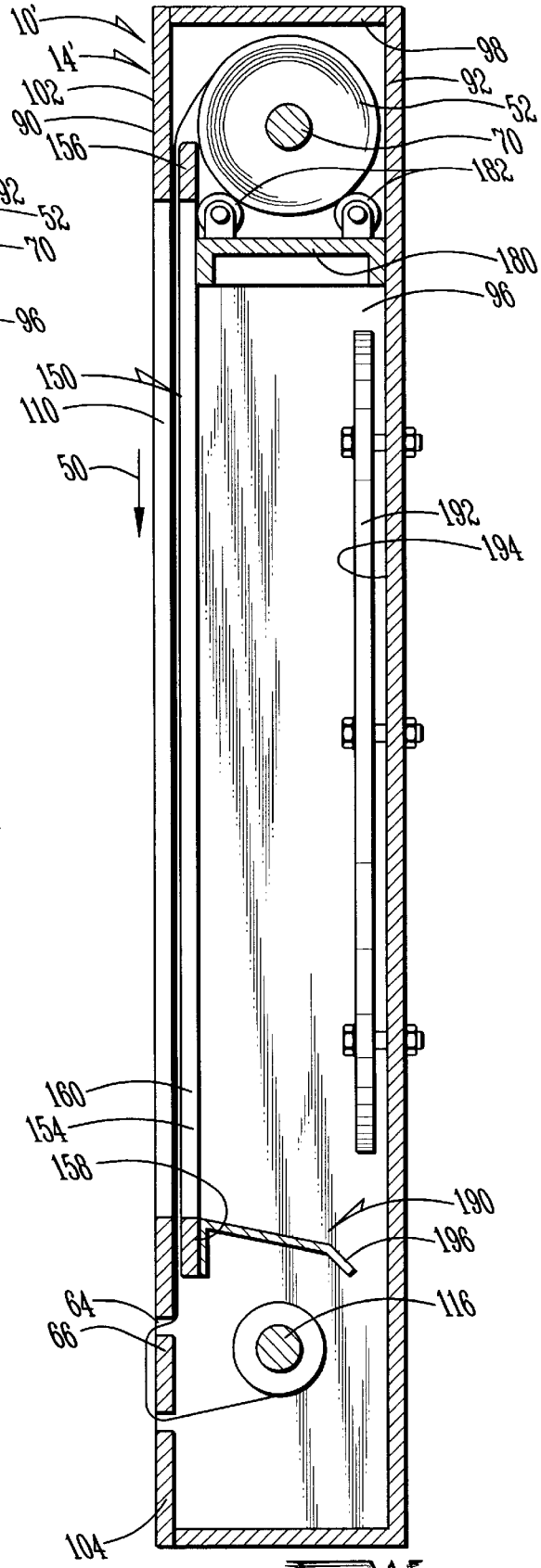
FIG. 15 is a cut-away side elevational view of the FIG. 9 target assembly showing the casters used to guide the feed roll of target-containing paper.
Figure 17:
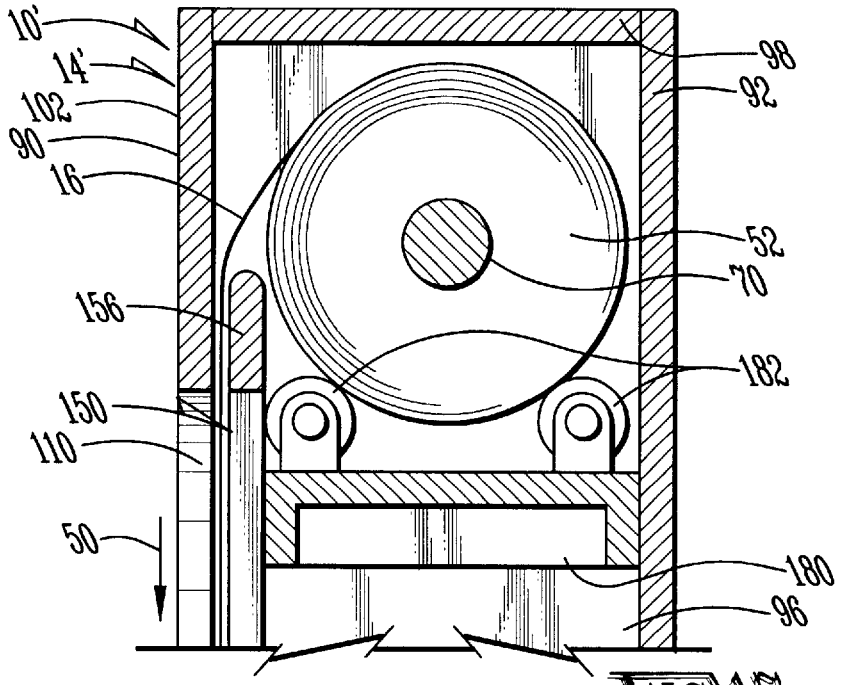
FIG. 17 shows the target-roll supply in a supported condition.
Figure 18:
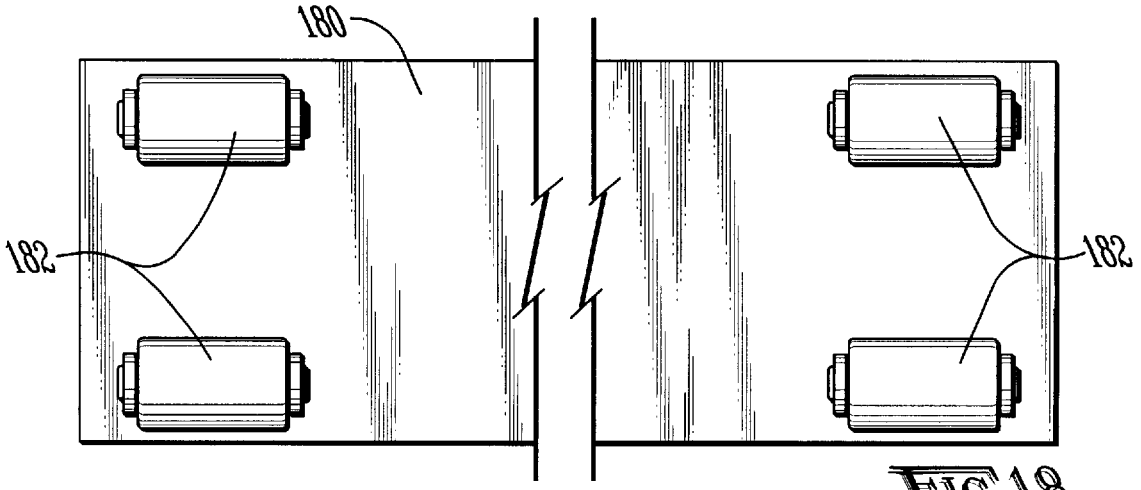
FIG. 18 is a top plan view of the casters used to support the supply roll of target paper.

As shown in FIGS. 15, 17 and 18, roll 52 of target-containing paper is additionally supported on a shelf 180 that is fixed to the inside surface of the frame near the top area of the frame. Casters 182 are mounted on shelf 180 and rollably engage roll 52 to guide and control the feeding of target-containing paper 16 in direction 50.

Figure 14:
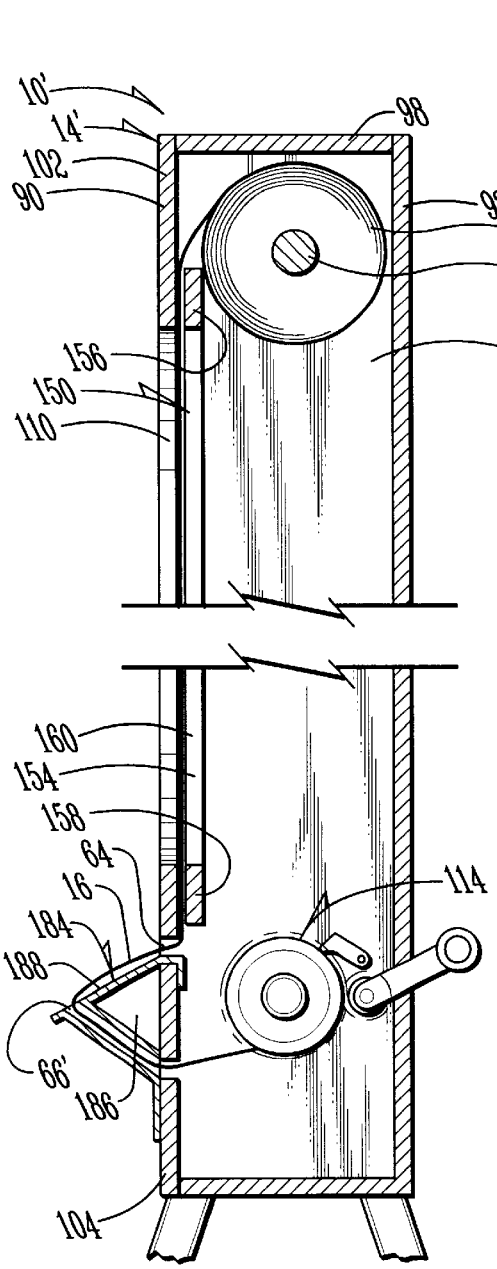
FIG. 14 is a cut-away view of a portion of the target assembly showing an element for guiding and supporting target-containing paper as that paper exits the target assembly and positioning that paper for cutting to remove a used target from the roll of paper.

As shown in FIG. 14, assembly 10' can include a unit 184 for assisting the cutting of a used target from the roll. Unit 184 includes a guide element 186 mounted on the outside surface of front 90 sub-adjacent to exit slot 64. A cutting slot 66' is defined in element 186 and element 186 is shaped and angled to guide the target paper outward and away from the outside surface of front 90. Top surface 188 of element 186 can support paper 16 while a shooter writes on that paper to record data regarding the test.

Figure 19:
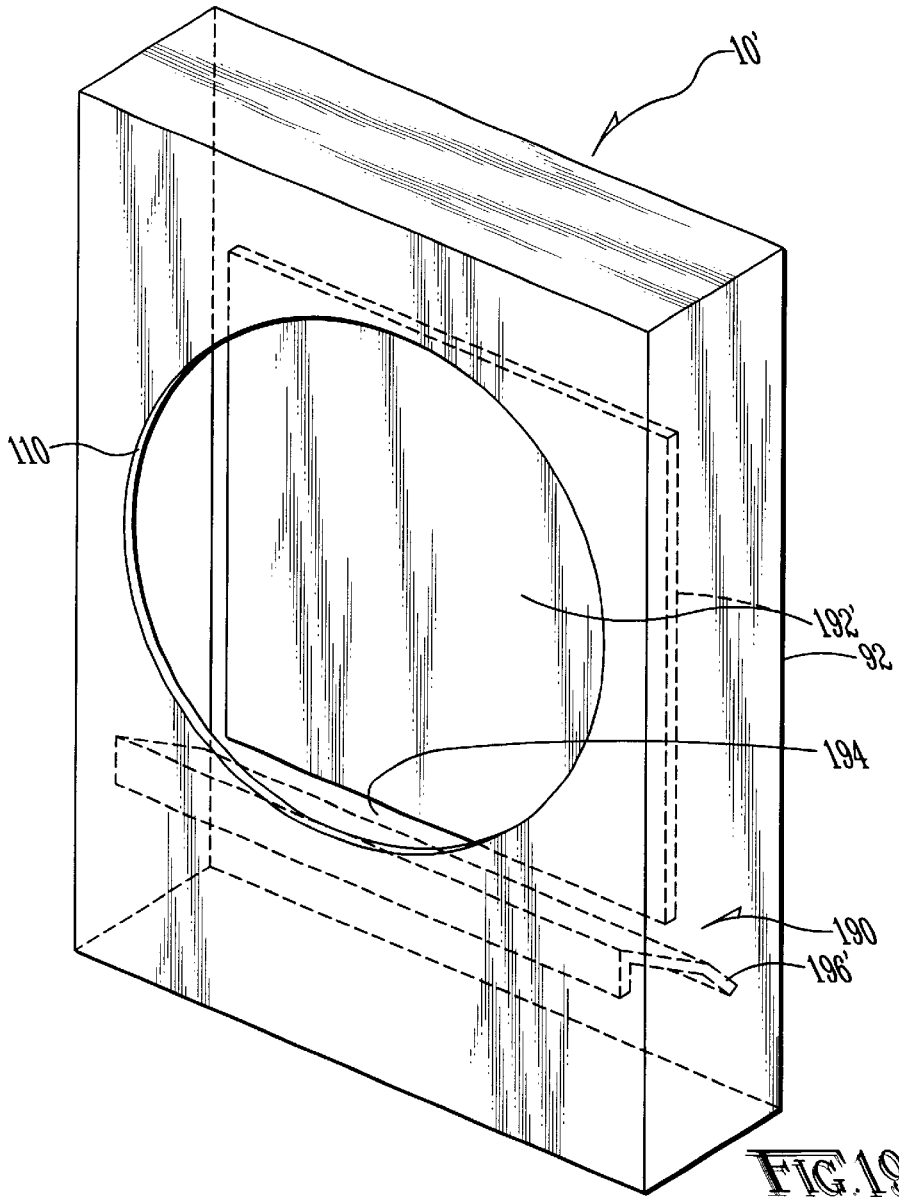
FIG. 19 is a perspective view showing one form of a shot controlling assembly of the target assembly.

Assembly 10' includes a shot collection unit 190 that collects shot after that shot has passed through the targets. Shot collection unit 190 is shown in FIGS. 11, 15, 19 and 27. Shot collection unit 190 includes a splatter plate 192 mounted on the inside surface 194 of rear 92 and which receives the shot after it has passed through the target and a shot deflection plate 196 mounted on the inside surfaces of the frame sides near the bottom of the frame. Shot deflected by the splatter plate falls onto the deflection plate and is directed to the rear area of the frame for later collection and/or disposal. An alternate form of the shot collection unit is shown in FIG. 19 as having a splatter plate 192' that surrounds the inner surfaces of the frame and has a deflection plate 196' that is one-piece therewith.

It is understood that while certain forms of the present invention have been illustrated and described herein, it is not to be limited to the specific forms or arrangements of parts described and shown.

What is claimed is:

1. A target assembly comprising:

a frame having a top, a bottom, a front, a rear surface and sides when in an operative orientation;

a target containing roll support located near the top of said frame;

a target containing roll of rosin paper supported on said target containing roll support when in an operative orientation;

a guide roll on said frame near the top of said frame;

said rosin paper extending over said guide roll and extending along the front of said frame;

a target area defined in said frame;

said rosin paper extending in front of said target area;

an exit slot in said frame located between said target area and the bottom of said frame;

a second guide roll mounted on said frame adjacent to the rear surface of said frame and adjacent to said exit slot;

a cutting slot in said frame located between said exit slot and the bottom of said frame; and said target containing roll of rosin paper extending along the front of said frame and around said second guide roll and out of said exit slot to the front of said frame and along the front of said frame and in front of said cutting slot.

2. The target assembly defined in claim 1 further including a back on said frame, said back having an opening defined therethrough, said target containing roll of rosin paper being located between the front of said frame and the back on said frame and being accessible through the opening defined through the back on said frame.

3. The target assembly defined in claim 1 further including a target support on said frame adjacent to said target area.

4. The target assembly defined in claim 3 further including a back on said frame, said back having an opening defined therethrough.

5. The target assembly defined in claim 1 further including a target-containing roll take-up roll on said frame between said exit slot and the bottom of said frame.

6. The target assembly defined in claim 5 further including a hand crank connected to said take-up roll.

7. The target assembly defined in claim 5 further including a shot collection unit on said frame.

8. The target assembly defined in claim 5 further including a shot deflection element on said frame.

9. The target assembly defined in claim 1 further including a guide element located between said exit slot and said cutting slot.

10. The target assembly defined in claim 1 further including legs on said frame.

11. The target assembly defined in claim 7 further including a shot splatter plate on said frame adjacent to said target area.

12. The target assembly defined in claim 6 further including a ratchet mechanism on said hand crank and on said frame adjacent to said hand crank.

13. The target assembly defined in claim 1 wherein said target area is arcuate.

14. The target assembly defined in claim 2 wherein said rosin paper is rosin sized sheathing.

15. A target assembly comprising:

a frame having a top and a bottom a front, a back, and sides when in an operative orientation;

a target-containing roll support near the top of said frame;

a target-containing roll of rosin paper supported on said target-containing roll support when in an operative orientation;

a target area defined in the front of said frame between the top and the bottom;

a target-containing roll exit slot defined through said frame between said target area and the bottom of said frame;

a target-containing roll cutting slot defined through said frame between said exit slot and the bottom of said frame;

a target-containing roll take-up roll on said frame between said exit slot and the bottom of said frame; and a hinge connecting the front of said frame to one of the sides of said frame.

16. The target assembly defined in claim 15 further including a lock on said frame.

17. A target assembly comprising:

a frame having a top and a bottom when in an operative orientation;

a target-containing roll support near the top of said frame;

a target-containing roll of rosin paper supported on said target-containing roll support when in an operative orientation;

a target area defined in said frame between the top and the bottom;

a target-containing roll exit slot defined through said frame between said target area and the bottom of said frame;

a target-containing roll cutting slot defined through said frame between said exit slot and the bottom of said frame; and a top shelf on said frame adjacent to said target-containing roll support, said top shelf including casters thereon.

* * * * *